United States Patent [19]

Vignoli

[11] Patent Number: 4,854,892

[45] Date of Patent: Aug. 8, 1989

[54] ELECTRICAL CONNECTOR WITH LATCHING MECHANISM

[75] Inventor: Guido Vignoli, Alta, Italy

[73] Assignee: AMP Incorporated, Harrisburg, Pa.

[21] Appl. No.: 223,578

[22] Filed: Jul. 25, 1988

[30] Foreign Application Priority Data

Nov. 16, 1987 [GB] United Kingdom ..... 8726808

[51] Int. Cl.[4] ..... H01R 4/24

[52] U.S. Cl. ..... 439/417

[58] Field of Search ..... 439/398–426

[56] References Cited

U.S. PATENT DOCUMENTS 3,835,444 9/1974 Plana et al. .
3,836,944 9/1974 Lawson .
4,138,184 2/1979 Knopp .
4,159,158 6/1979 Weidler .
4,330,164 5/1982 Puttman et al. ..... 439/395
4,648,674 3/1987 Sanchez, Jr. ..... 439/395

*Primary Examiner*—Joseph H. McGlynn
*Attorney, Agent, or Firm*—William B. Noll

[57] ABSTRACT

The improved connector of this invention comprises a housing body receiving a contact member having a conductor receiving end comprised of converging arms of plates and joined by straps to define wire connecting slots into which a wire is stuffed by an insulating cover member. The cover member includes a plurality of latching tabs, which in the first two instances latch the cover member to the housing body, and in the final instance latch the cover member to the contact member by engagement with straps.

4 Claims, 5 Drawing Sheets

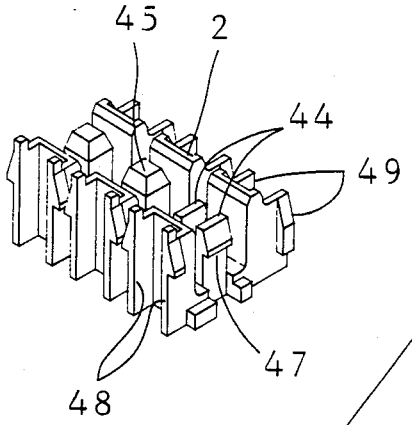
FIG. 1B
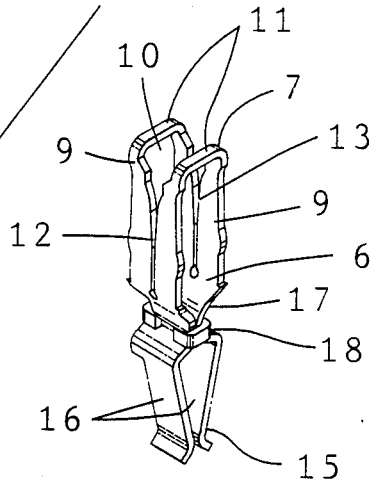
FIG. 1A
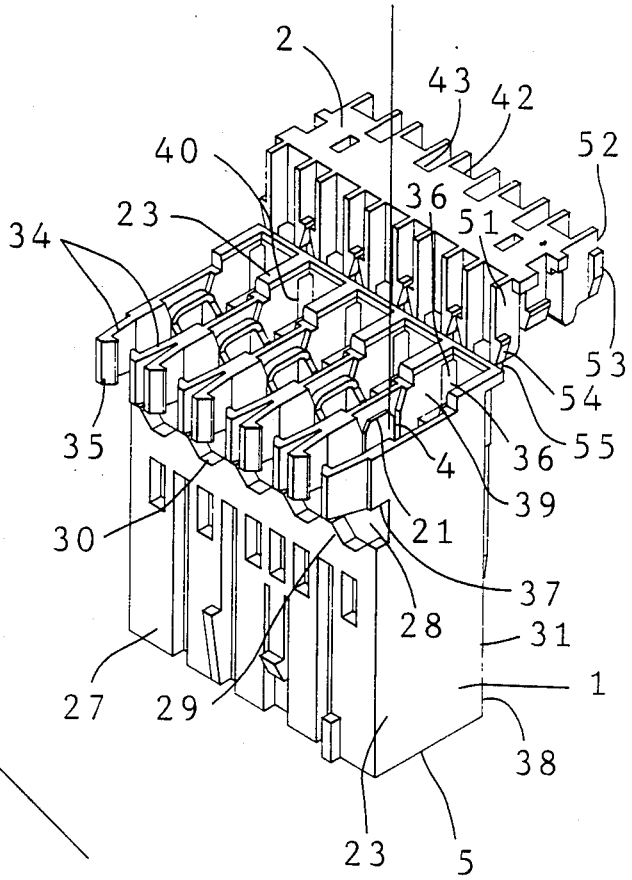

ELECTRICAL CONNECTOR WITH LATCHING MECHANISM

BACKGROUND OF THE INVENTION

This invention relates to an improvement in the electrical connector as disclosed in PCT International Application No. PCT/US87/01965. More particularly, it relates to an improved latching mechanism to maintain engagement of the connector housing and cover in situations where the connector may be subject to vibrations. The invention is generally directed to an electrical connector of the type in which a conductor can be terminated by forcible insertion transversely of its axis along a conductor receiving slot of a contact member. Such contact member is mounted in a cavity in an insulating housing body adjacent one end and retained in the slot by engagement with a cover member movable into latching engagement with the housing body to engage the conductor thereby to retain the conductor in the slot.

In connectors of this type, the cover member is provided with latching projections engageable in eyes formed in the housing body adjacent a cover member receiving end to latch the cover member to the housing body.

Such connectors have become increasingly widely used, particularly in the automotive and domestic appliance industries as they are well adapted for assembly by automated, mass production, techniques and yet ensure a very reliable, insulated, electrical connection to the conductor fur use in adverse environments subject to vibration.

In some applications it is necessary for the conductor to be retained while bent through a right angle to extend in the direction of the slot axis as it exists from a first side of the housing body, as described in French Patent No. 8000301 (4851). In that prior proposal, the cover member is formed with a conductor receiving channel formed with inwardly directed projections which secure the existing portion of conductor in the channel thereby retaining the conductor in bent condition.

However, disadvantages of using the cover to retain the conductor in bent condition are that the considerable stress imposed on the cover, which is a relatively small plastic part, increases the distortion of the cover with risk of unlatching from the housing body or reduction in the force retaining the conductor in the slot, reducing the electrical reliability. Additionally, vibrations may cause the cover to become disengaged from the housing.

SUMMARY OF THE INVENTION

According to this invention, means are provided to improve the latching of the cover member to the housing body, while retaining the ability thereof to latch releasably adjacent connector bodies together to form a strip of connectors which can be fed automatically to conduct terminating apparatus and, preferably, stored on reels. The improved latching is achieved in an electrical conductor system which includes a contact member mounted in a cavity in an insulating housing body, where said contact member comprises a conductor connecting end constituted by a pair of interconnected parallel plates joined by a pair of transverse straps, and a tab or board receiving end, and said cover member comprises (a) first and second latching projections receivable in corresponding eyes or slots of the housing body to constitute a first latching of the cover member of the housing body, and (b) a pair of central projections adapted to be received between said transverse straps, and that said projections are provided with latching tabs to engage said transverse straps when the cover member is brought into engagement with said housing body.

BRIEF DESCRIPTION OF DRAWINGS

An example of an electrical connector according to this invention will now be described with reference to the accompanying drawings in which:

FIG. 1A is a perspective view of a first side of the connector with an electrical contact member exploded therefrom and the cover member integrally joined to the housing body prior to its separation therefrom;

FIG. 1B is a fragmentary perspective view of an underside of the cover member and showing the improved latching mechanism of this invention;

DETAILED DESCRIPTION OF PREFERRED EMBODIMENT

Figure 2A:
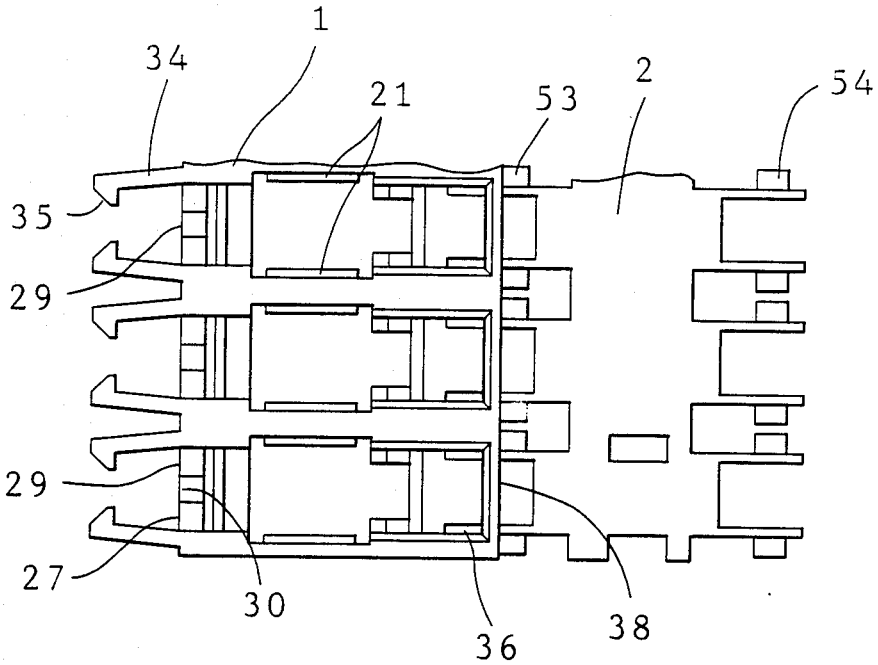
FIG. 2A is a fragmentary plan view of the connector housing.
Figure 2B:
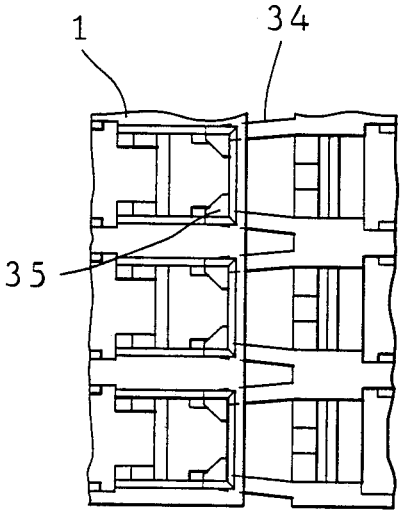
FIG. 2B is a fragmentary plan view of adjacent housing bodies linked together for forming a strip.

The connector comprises a housing body 1 and cover member 2 moulded in one piece of a plastic insulated-type material. The housing body 1 is formed with a row of elongate cavities 3 opening to opposite cover member receiving and mating ends 4 and 5 respective of the housing body and each receiving a contact member 6 of generally known form.

Each contact member 6 is stamped and formed in one piece from sheet metal strip and comprises a conductor connecting end 7 constituted by a pair of interconnected parallel plates 9 joined by a pair of transverse straps 11 to define a wire receiving mouth 10 converging to a pair of aligned wire receiving slots 12 and 13 in respective plates; and a tab or board receiving end 15 constituted by a pair of limbs 16 extending in opposed relation from an intermediate, waisted, portion 17 at which ears 18 extending from one strip portion are clinched around an opposite strip portion to secure the plates 9 and limbs 16 together. When a contact member 6 is inserted into a cavity 3, the straps 11 engage shoulders 21 formed on opposed end walls 23 of the cavities thereby preventing further movement into the cavity and providing support for the contact during wire insertion, as described in UK Patent No. 1574909 (8971).

Figure 3:
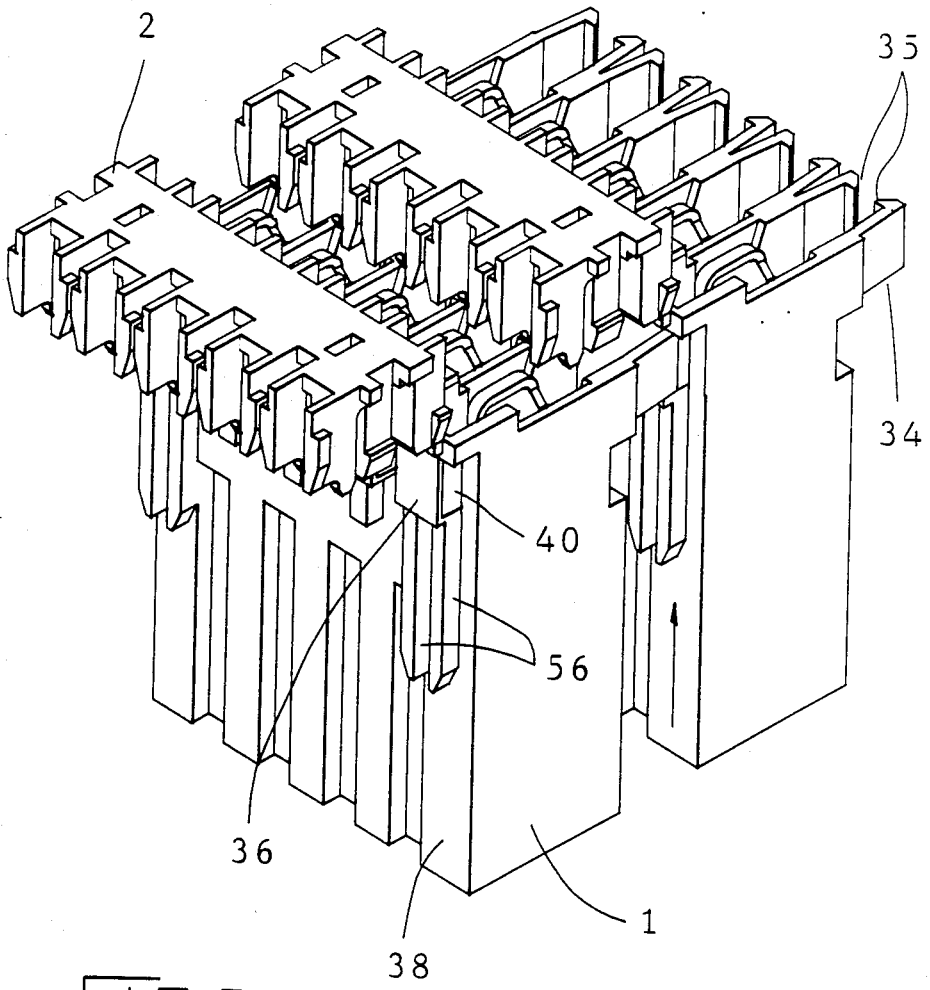
FIG. 3 is a perspective view of a pair of connectors linked together for forming a strip.
Figure 4:
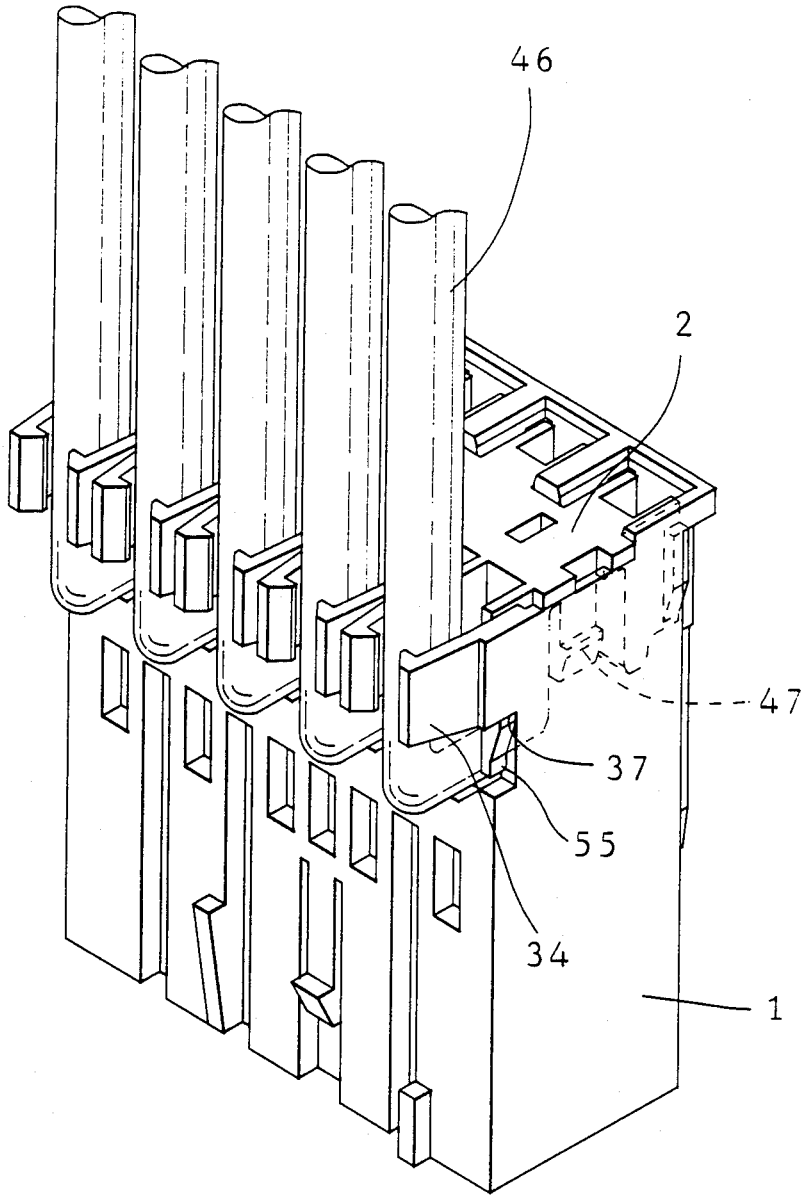
FIG. 4 is a perspective view of a connector terminating a series of conductors.

The mating end 5 of the housing body 1 is formed with a printed circuit board or tab receiving slot 22 aligned with respective board or tab receiving ends 15 of the respective contact members 6, and a projection 25 may be formed on one edge of the slot for engagement in an aperture in a printed circuit board, for example, to retain the connector on the board. A first side wall 27 of the housing body is rebated from the cover receiving end to provide a wire exit aperture 28, the upper edge 29 of the wall being recessed to cradle the conductor and having a wire gripping tooth 30. Side wall 31, opposite the first side wall 27, is formed with a pair of spaced-apart wire supporting shoulders 32 aligned with the edge 29. A row of pairs of latching arms 34 having inwardly directed projections 35 at their ends extend in mutually opposed, spaced relation transversely of each housing cavity axis from the first side wall at the cover member receiving end 4 of the housing body 1. A pair of cover member latching shoulders 37 are defined by rebates formed immediately below the latching arms 34. A cover member receiving pocket 36 extends in the opposite direction from a second, opposite, side wall 38 at the cover member receiving end 4 of the housing body 1 and is formed in opposite end walls 39 with a pair of opposed latching eyes 40 aligned to receive the projections 35 of another housing body 1 located in side-by-side relation (as shown in FIG. 3).

The cover member 2 comprises a row of segments 42 interconnected by webs 43. Each segment 42 is shaped for receipt in the cavity 3 in the cover member receiving end 4, with the webs 43 then overlying the end walls 23 between adjacent cavities. Typically, the cover contains a plurality of segments 42, a number which is consistent with the number of cavities 3 in the housing. However, this invention also contemplates a single cavity version, not illustrated. Nevertheless, in accordance with the multi-cavity version of this invention, at least the end-most segments 42, that is, one at either end of the cover member 2, are each characterized by a pair of central projections 44 adapted to be received between straps 11 of a corresponding contact member 6. The ends of projections 44 are provided with latching tabs 47, the purposes of which are to engage beneath straps 11 when the cover 2 is brought into engagement with the housing body 1. This provides one of several latching means for the connector.

For the internal segments 42 of the cover 2, each such segment may include a central land 45 shaped to be received between the plates 9 and straps 11 of a contact member 6 when the cover member 2 is applied to the housing body 1, thereby to serve as a stuffer member for a conductor 46 to be connected to the contact member 6, as will be described below.

Figure 5:
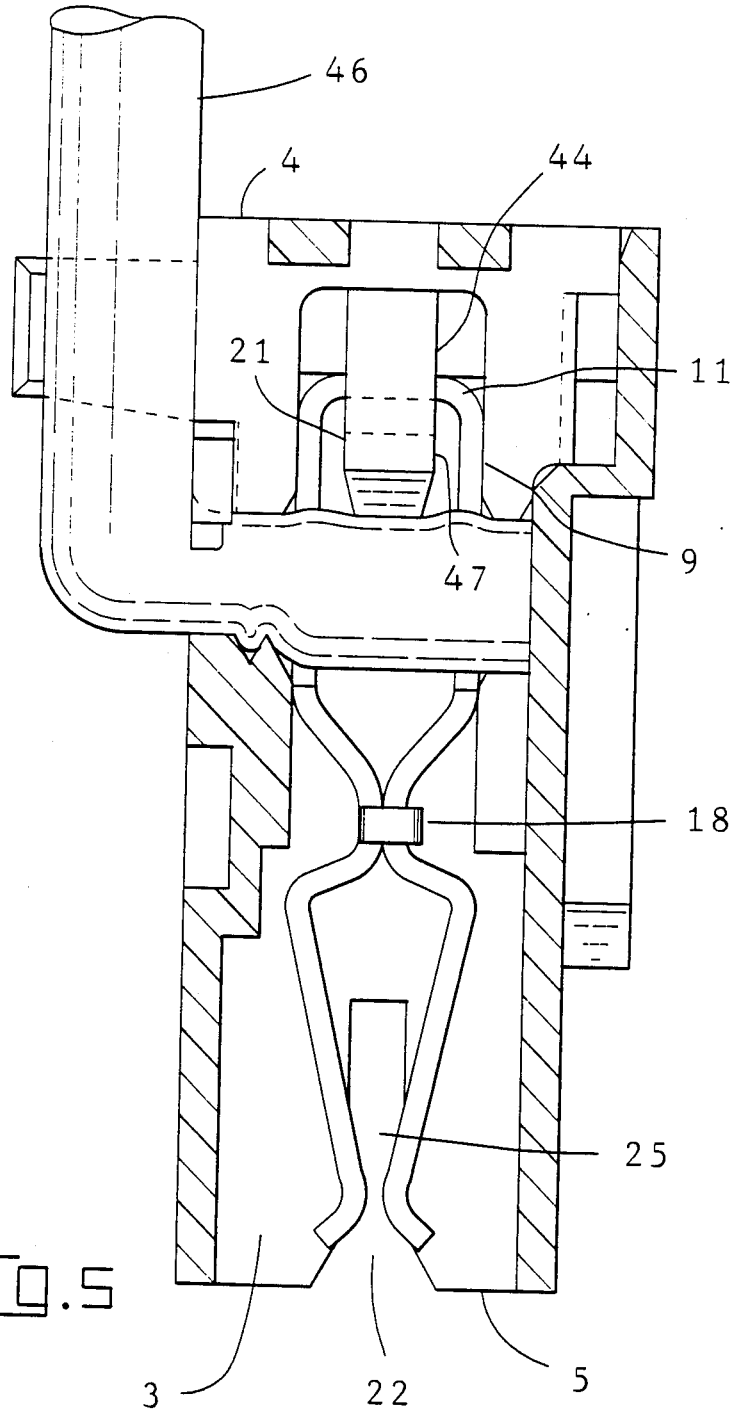
FIG. 5 is a cross-sectional view of the connector shown in FIG. 4 showing an end-most cavity utilizing the latching mechanism of this invention.

The balance of the latching mechanism will not be described. On either side of the projections 44 and internal lands 45 there are further lands 48 and 49 each shaped to be received in the housing body 1, such adjacent lands 45 and 48, and 45 and 49, embrace end portions of the two plates 9 of the contact member 6 respectively, as shown in FIG. 5.

First and second pairs of cover latching limbs 51 and 52 having outwardly directed cover latching ramps 53 and 54, respectively, extend in mutually spaced parallel relation from lands 48 and 49, the limbs 51 being integrally joined to a back wall of the pocket 36 by vertical extensions 55.

As shown in FIG. 3, adjacent housing bodies 1 can be releasably linked together to form a strip by relative movement in the direction indicated by the arrow with the latching arms 34 receiving between them a guide rib 56 formed on the second side wall of the housing body 1 until the projections 35 are received in the latching eyes 40 in the pocket with a snap action. The projections 35 and corners of the pocket 36 adjacent a base wall may be formed with chamfers and inclined guiding surfaces to facilitate the linking.

To enable conductor termination, successive housing bodies 1 may be released from the strip by movement in the opposite direction and the cover member 2 sheared from its housing body 1 in known fashion.

An end of an insulated conductor is then inserted into the cover receiving end 4 of the housing body 1 between the straps 11 in the mouth 10 of the contact member 6 and the cover member 2 forced into the cavity 3 at the cover receiving end 4 so that the projections 44 and/or lands 45 force the conductor along the slots 12 and 13 with the slot edges contacting the conductor core until the latching ramp 53 snaps under the shoulder 37, and ramp 54 snaps into the eyes 40, thereby securely latching the cover member 2 to the housing body 1. During such movement, the extensions 55 may engage the recessed edge 29 of the side wall 27 tending to curl around the conductor. Finally, as part of such movement, latching tabs 47 slip under and engage straps 11, to lie adjacent shoulder 21.

Subsequent to the termination described above, the exit portion of the conductor 46 is bent through a right angle into the embrace of the latching arms 34 to extend in the direction of the slot and cavity axes and secured in such position by engagement with the projections 35.

I claim:

1. An improved electrical connector of the type in which a conductor can be terminated by forcible insertion transversely of its axis along a conductor receiving slot of a contact member mounted in a cavity in an insulating housing body adjacent one end and retained in the slot by engagement with a cover member movable into latching engagement with the housing body to engage the conductor, where said contact member comprises a conductor connecting end constituted by a pair of interconnected parallel plates joined by a pair of transverse straps, and a tab or board receiving end, and said cover member comprises first and second latching projections receivable in corresponding eyes or slots to thereby latch the cover member to the housing body, where said cover member is provided with a pair of central projections adapted to be received between straps, and that said projections are provided with latching tabs to engage straps when the cover member is brought into engagement with housing body.

2. An improved electrical connector according to claim 1, where said cover member and housing body, respectively, include a plurality of cover segments and a like number of cavities, and that each of the end-most cover segments is provided with said central projections.

3. An improved electrical connector according to claim 1, where each said cavity includes a pair of shoulders against which the straps seat when the contact member is inserted into the cavity, and that said latching tabs lie adjacent the shoulders.

4. An improved electrical connector according to claim 2, where said cover member contains a plurality of segments, and that only the two end segments contain latching projections for engagement with a corresponding contact member.

* * * * *